US005370337A

United States Patent [19]

Pratt

[11] Patent Number: 5,370,337

[45] Date of Patent: Dec. 6, 1994

[54] EXPANDABLE SHAFT

[76] Inventor: Donald P. Pratt, 9875 New Oregon Rd., Eden, N.Y. 14057

[21] Appl. No.: 119,998

[22] Filed: Sep. 10, 1993

[51] Int. Cl.[5] ..... B65H 75/24

[52] U.S. Cl. ..... 242/571.1

[58] Field of Search ..... 242/571.1, 571.2; 279/2.08, 2.05, 2.06; 269/48.1, 48.2, 48.3, 48.4; 82/169

[56] References Cited

U.S. PATENT DOCUMENTS

| | | | |
|---|---|---|---|
| 2,062,421 | 12/1936 | Lindbom | 279/2.08 X |
| 3,096,949 | 7/1963 | Huffman | 242/571.1 |
| 3,388,916 | 6/1968 | Winnen et al. . | |
| 3,834,257 | 9/1974 | Ganser . | |
| 4,099,732 | 7/1978 | Threatt . | |
| 4,828,198 | 5/1989 | Kann et al. | 242/571.2 |

OTHER PUBLICATIONS

Converting Magazine, Apr. 1994 Issue, advertisement on rear of p. 8 (3 sheets).

*Primary Examiner*—John M. Jillions
*Attorney, Agent, or Firm*—Joseph P. Gastel

[57] ABSTRACT

An expandable shaft for mounting of a hollow core having an internal surface including an elongated polygonal base member having an axis of rotation, outer surfaces on the member defining a circumference having a diameter which is slightly less than the diameter of the internal surface of a core which is to be mounted on the expandable shaft, a selectively inflatable elongated expandable bladder extending longitudinally on the elongated base member in circumferentially spaced relationship to the outer surfaces for engaging the inside surface of the core and drawing it into engagement with the plurality of surfaces when the elongated expandable bladder is inflated.

11 Claims, 3 Drawing Sheets

EXPANDABLE SHAFT

BACKGROUND OF THE INVENTION

The present invention relates to an improved expandable shaft construction.

Expandible shafts are utilized on web winding machinery for mounting cores onto which webs are wound and unwound. In the past, insofar as known, expandable shafts were relatively complex in construction.

SUMMARY OF THE INVENTION

It is the primary object of the present invention to provide an improved expandable shaft which is extremely simple in construction and reliable in operation.

Another object of the present invention is to provide an improved expandable shaft which can be mounted and demounted from an associated web winding machine in an extremely simple and expedient manner. Other objects and attendant advantages of the present invention will readily be perceived hereafter.

The present invention relates to an expandable shaft for the mounting of a hollow core having an internal surface comprising an elongated base member having an axis of rotation, a plurality of outer surface means fixedly mounted on said base member located at a predetermined distance from said axis of rotation and substantially defining a circumference having a diameter which is slightly less than the diameter of said internal surface of said core, a selectively inflatable elongated expandable bladder extending longitudinally on said elongated base member in circumferentially spaced relationship to said plurality of outer surface means for engaging said inside surface of said core and drawing said inside surface of said core into engagement with said plurality of surface means when said elongated expandable bladder is inflated.

The various aspects of the present invention will be more fully understood when the following portions of the specification are read in conjunction with the accompanying drawings wherein:

DESCRIPTION OF THE PREFERRED EMBODIMENTS

Figure 1:
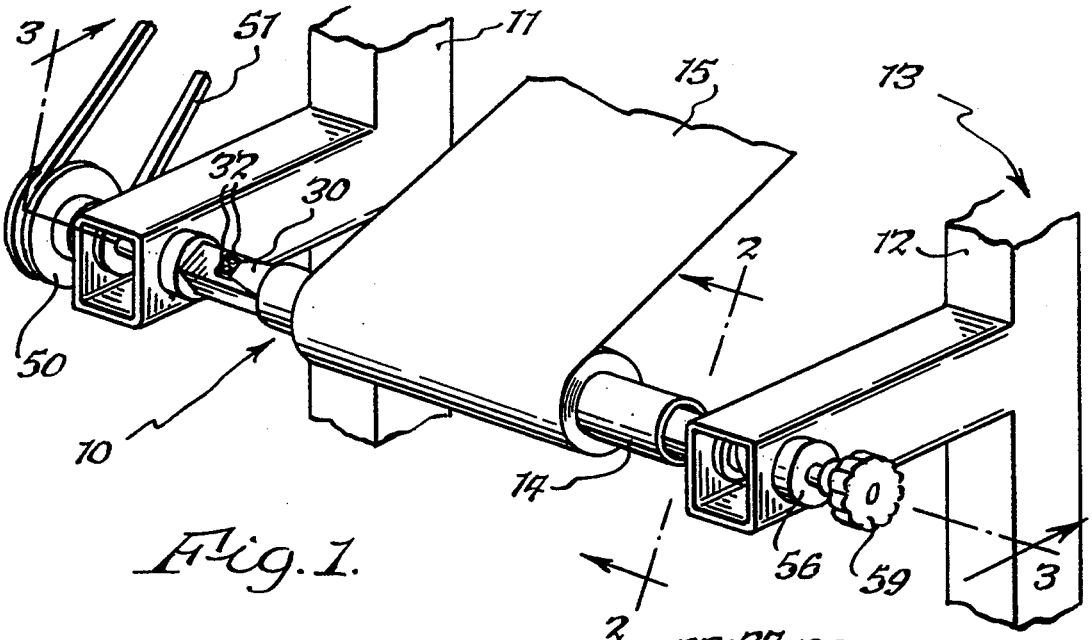
FIG. 1 is a fragmentary perspective view of the improved expandable shaft mounted on a web winding machine.

The expandable shaft 10 is shown in FIG. 1 as mounted between the sides 11 and 12 of a web winding machine 13. Broadly, a core 14 is selectively mounted on expandable shaft which is rotated to cause a web 15 to be wound onto core 14.

The expandable shaft 10 includes a square tube 17 (FIGS. 2, 3, 5 and 7) having sides 19, 20, 21 and 22 and an axis of rotation 16. Channels 23, 24 and 25 are fixedly mounted on sides 19, 20 and 21, respectively, by a plurality of screws 27 which are longitudinally spaced along the channel members. The ends of the legs 23', 24' and 25' of channels 23, 24 and 25, respectively, bear against the outsides of sides 19, 20 and 21, respectively, of base member 17. The bases **23*b*, 24*b* and 25*b* of channels 23, 24 and 25, respectively, lie parallel to the sides 19, 20 and 21, respectively. The channel corners 23*c*, 24*c* and 25*c* and the corners 18 of square tube 17 lie on a cylindrical circumference having a diameter which is slightly less than the diameter of the internal cylindrical surface 29 of core 14. In this respect, the corners of the channels and the corners 18 of the square tube 17 lie on a circumference having a diameter which is about 1/16" smaller than the inner diameter of a core 14 so that the core can be slid easily onto expandable shaft 10**.

Figure 2:
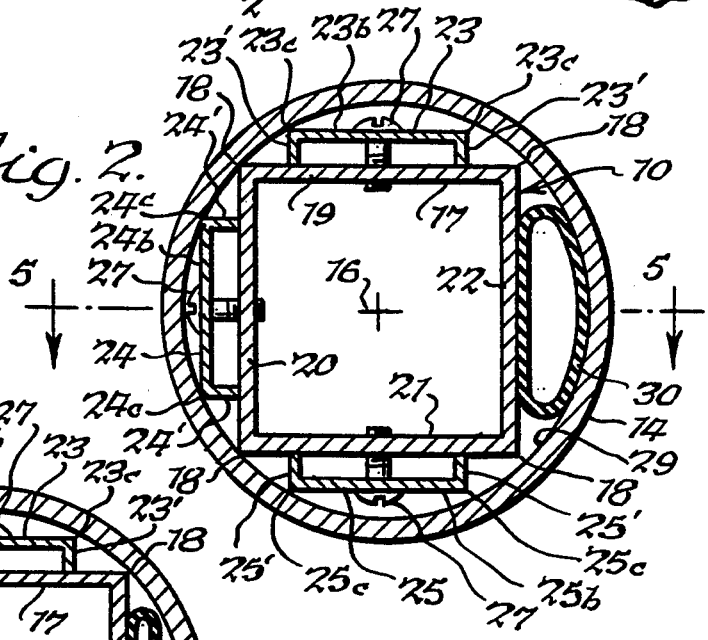
FIG. 2 is a cross sectional view taken substantially along line 2—2 of FIG. 1 and showing a core mounted in driven relationship on the expandable shaft when the bladder is inflated.
Figure 2A:
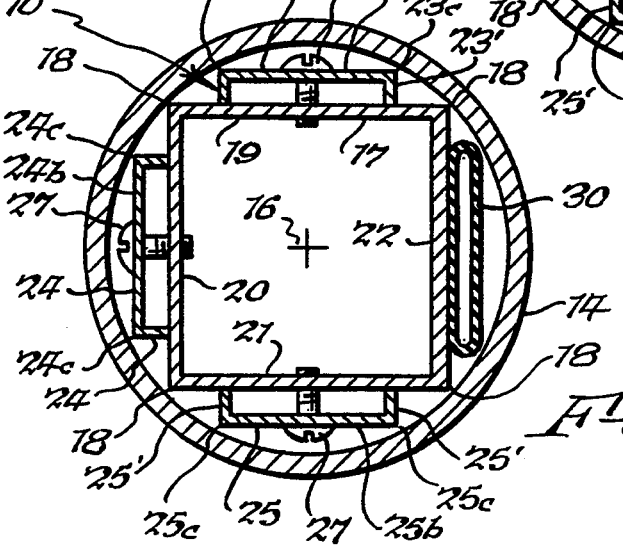
FIG. 2A is a view similar to FIG. 2 but showing the relative sizes of the expandable shaft and the core when the bladder is deflated.

An elongated expandable bladder 30 of the relaxed cross section substantially shown in FIG. 2A has its end 31 secured to the side 22 of base member 17 by a plurality of screws 32 and its opposite end extends through opening 33 in side 22 and is mounted on fitting 34 of valve member 35 which has a valve stem 37 extending out through opening 33. Valve stem 37 is the type used on automobile tires and through which compressed air can flow into and out of bladder 30. Valve member 35 is suitably secured between sides 19 and 21 by a pin 39. The outer end of valve stem 37 lies within the circumference of a core which is to be mounted on expandable shaft 10 so that the core 14 can pass over it.

When the expandable shaft 10 is not mounted on winding machine 13 and when the elongated bladder 30 is deflated, as shown in FIG. 2A, a core 14 can be slid longitudinally over expandible shaft 10 from either direction because the corners 18 and **23*c*, 24*c* and 25*c* and the bladder 30 and the outer end of valve stem 37 lie within a circumference which is smaller than the internal circumference of the core. It is only after the elongated bladder 30 is inflated by compressed air, as shown in FIG. 2, that the core is pulled into engagement with one of the corners 23c, the two corners 24c and one of the corners 25c and the two corners 18 at the ends of side 20. However, there will be a clearance between the inside surface of the core 14 and the corners 18 at the ends of the bladder mounting side 22 and the two channel corners 23c and 25c closest to bladder 30 because the core 14 will have shifted to the right in FIG. 2 from its position in FIG. 1 due to the inflation of bladder 30**.

The expandable shaft 10 is mounted on the web winding machine 13 in the following manner. One end 40 (FIGS. 3 and 7) fits onto portion 41 of drive stud 42 and it abuts lip 43 which is circular. Portion 41 is essentially of square cross section with rounded corners. The opposite end 44 of expandable shaft 10 is mounted on a member 42' which is the mirror image of portions 41 and 43 of drive stud 42 and which has portions 41'' and 43' which are the mirror images of portions 41 and 43. It can readily be seen from FIG. 7 that portion 41 of drive stud 42 has sides which abut the insides of tube 17 and thus create a driving relationship therewith. Drive stud 42 is pinned to shaft 45 mounted in bearings 47 and 49 of side 11 of web winding machine 13. A pulley 50 is also pinned to shaft 45 and is driven by belt 51 from a suitable motor.

Figure 3:
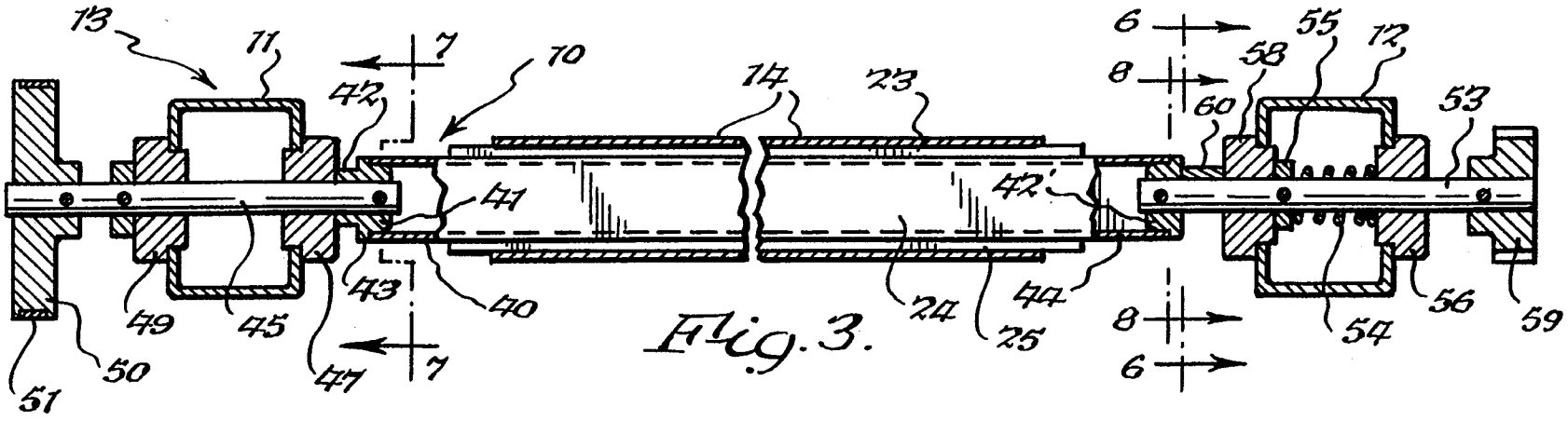
FIG. 3 is a fragmentary cross sectional view taken substantially along line 3—3 of FIG. 1 and showing the details for mounting the expandable shaft on the web winding machine.
Figure 4:
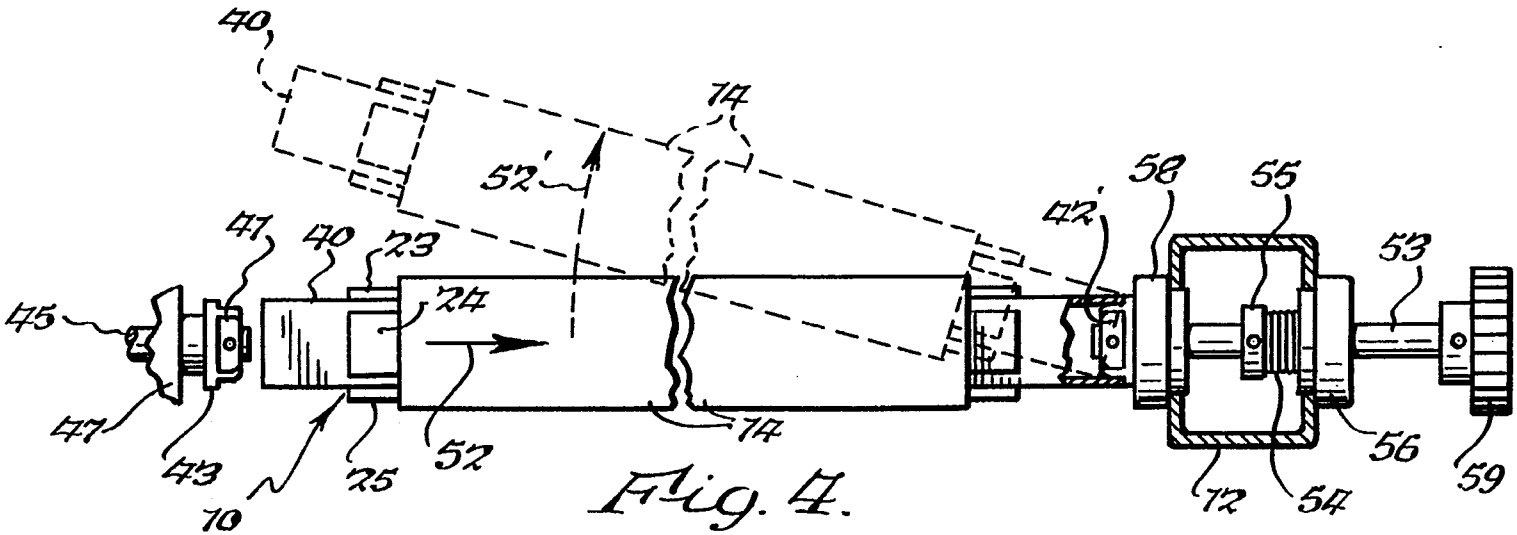
FIG. 4 is a fragmentary side elevational view, partially in cross section, showing one way in which the expandable shaft can be mounted on and demounted from the web winding machine.

In order to dismount expandable shaft 10 from its mounted position of FIG. 3, it is merely necessary to move it to the right in the direction of arrow 52 in FIG. 4 to cause the shaft 53 to which member 42' is pinned to move to the right against the bias of spring 54 which is moved from its expanded position in FIG. 3 to its compressed position in FIG. 4 by disc 55 which is pinned to shaft 53. Thereafter shaft 10 can be pivoted in the direction of arrow 52'. Shaft 53 is mounted in bearings 56 and 58 mounted on machine side 12. A knob 59 is pinned to shaft 53 in the event it is desired to manually move shaft 53 to the right, rather than to force it to the right by moving expandable shaft 10 in the direction of arrow 52. The expandable shaft 10 can be dismounted in the manner discussed above relative to FIG. 4 only when locking tab 60 (FIGS. 3 and 6) is in the vertical dotted line position of FIG. 6. In this respect, tab 60 is pivotally mounted on pin 61 secured to machine side 12 and when it is in its dotted line position, shaft 53 can be moved to the right as described above, but when it is in the solid line position, such movement of shaft 52 is prevented because tab 60 lies on shaft 53 and is located between member 42' and bearing 58. Shaft 10 can also be dismounted by pulling on knob 59 to the right in FIG. 3 to disengage drive stud 42' from the inside of base member 17 and thereafter pivoting shaft 10 about drive stud 42. Shaft 10 can be mounted into the position of FIG. 3 by reversing the steps described above for dismounting it. After expandable shaft 10 has been dismounted from machine 13, valve member 35 is actuated to permit the compressed air to flow from bladder 30, whereupon the clearance is again realized between the inside of core 14 and the expandable shaft 10 so that the core 14 can be slid off of shaft 10.

Figures 5, 5A, 6, 7, 8, 9:
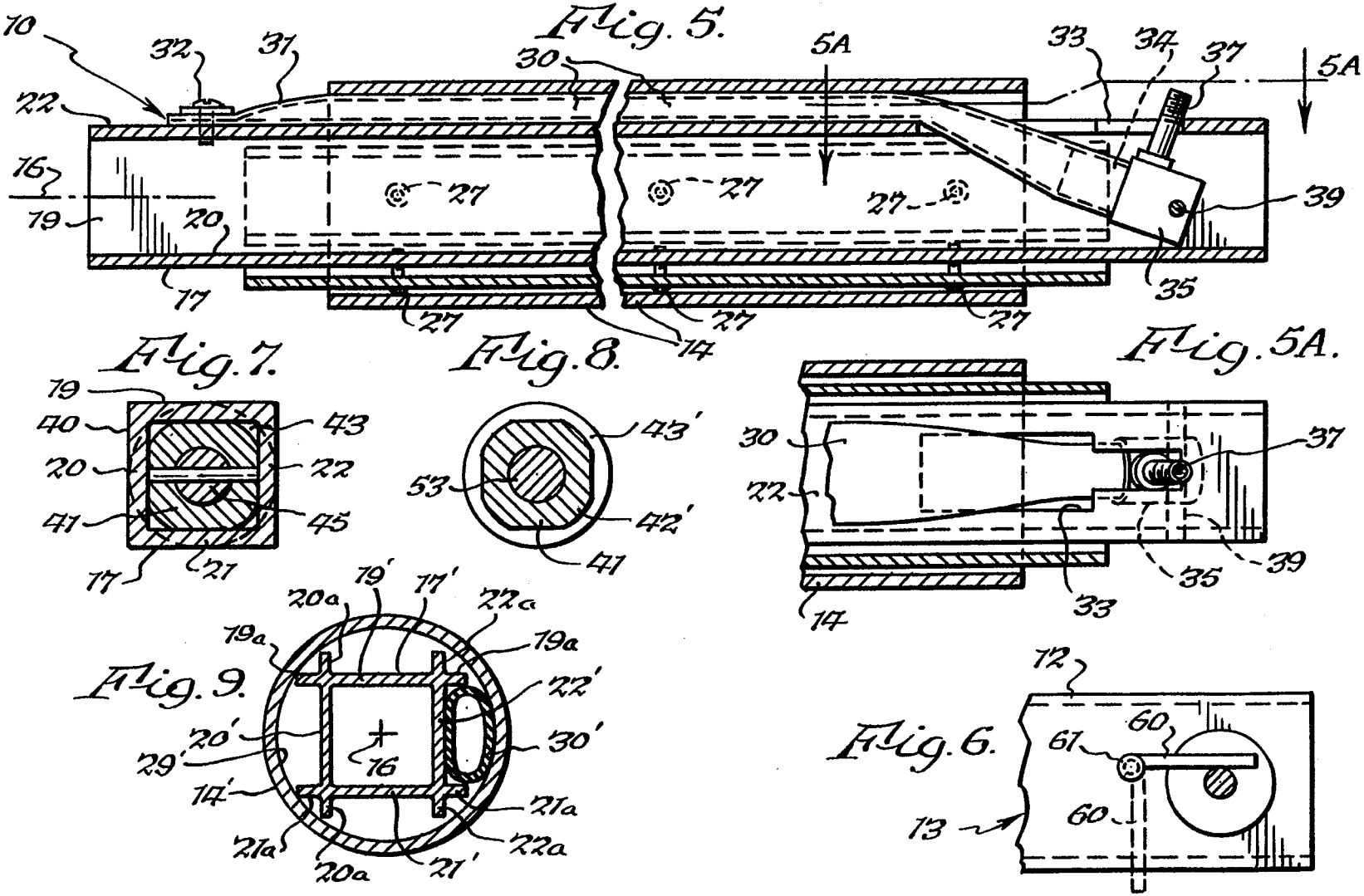
FIG. 5 is a fragmentary cross sectional view taken substantially along line 5—5 of FIG. 2 and showing the details of how the elongated expandable bladder is secured on the polygonal base.
FIG. 5A is a fragmentary view taken substantially in the direction of arrows 5A—5A of FIG. 5.
FIG. 6 is a fragmentary cross sectional view taken substantially along line 6—6 of FIG. 3 and showing the locking arrangement for locking the expandable shaft against removal from its installed operating position shown in FIG. 1.
FIG. 7 is a cross sectional view taken substantially along line 7—7 of FIG. 3 and showing structure for establishing a driving relationship with the expandable shaft.
FIG. 8 is a cross sectional view taken substantially along line 8—8 of FIG. 3 and showing the structure for mounting the end of the expandable shaft which is remote from the driven end thereof.
FIG. 9 is a cross sectional view similar to FIG. 2 but showing an alternate embodiment of the present invention.

In FIG. 9 an alternate embodiment of the expandible shaft is shown in cross section within a core 14'. The tubular member 17' is of the cross sectional configuration shown wherein the ends of sides 19', 20', 21' and 22' are extended in both directions to provide the extensions 19a, 20a, 21a and 22a, respectively, which serve the same functions as the channel members 23, 24 and 25. The outer corners of the extensions 19a, 20a, 21a and 22a lie on a circumference having a diameter which is approximately 1/16" less than the internal diameter 29' of core 14', and when bladder 30' is inflated, it will pull the core into contact with the outer end corners of extensions 20a and 22a and the corners of extensions 19a and 21a extending outwardly from side 20', but there will be a clearance at the corners of extensions 22a and the corners of extensions 19a and 21a which bracket bladder 30'.

While preferred embodiments of the present invention have been disclosed, it will be appreciated that the present invention is not limited thereto but may be otherwise embodied within the scope of the following claims.

What is claimed is:

1. An expandable shaft for the mounting of a hollow core having an internal surface comprising an elongated base member having an axis of rotation, a plurality of outer surface means fixedly mounted on said base member located at a predetermined distance from said axis of rotation and substantially defining a circumference having a diameter which is slightly less than the diameter of said internal surface of said core, a selectively inflatable elongated expandable bladder extending longitudinally on said elongated base member in circumferentially spaced relationship to said plurality of outer surface means for engaging said inside surface of said core and drawing said inside surface of said core into engagement with said plurality of surface means when said elongated expandable bladder is inflated.

2. An expandable shaft as set forth in claim 1 including valve means mounted on said elongated base member and in communication with said elongated inflatable bladder for selectively conducting compressed air relative thereto.

3. An expandable shaft as set forth in claim 2 wherein said valve means lies within said circumference to permit said core to pass thereover.

4. An expandable shaft as set forth in claim 1 wherein said elongated base member is a polygonal tube having a plurality of sides, and wherein said outer surface means extend outwardly from certain of said sides, and wherein said elongated expandable bladder is mounted on another of said sides.

5. An expandable shaft as set forth in claim 4 wherein said polygonal tube is guadrangular, and wherein said plurality of outer surface means comprise channel members secured to three of said sides, said channel members being oriented with their bases parallel to said sides to which they are secured.

6. An expandable shaft as set forth in claim 4 including valve means mounted on said elongated base member and in communication with said elongated inflatable bladder for conducting compressed air relative thereto.

7. An expandable shaft as set forth in claim 6 wherein said valve means lies within said circumference to permit said core to pass thereover.

8. An expandable shaft as set forth in claim 7 including means at the opposite ends of said polygonal tube for mounting said tube for rotation.

9. An expandable shaft as set forth in claim 1 including means at the opposite ends of said base member for mounting said base member for rotation.

10. An expandable shaft as set forth in claim 9 including valve means mounted on said elongated base member and in communication with said elongated inflatable bladder for selectively conducting compressed air relative thereto.

11. An expandable shaft as set forth in claim 10 wherein said valve means lies within said circumference to permit said core to pass thereover.

* * * * *